United States Patent [19]

Hartfelt et al.

[11] 4,138,228

[45] Feb. 6, 1979

[54] ABRASIVE OF A MICROPOROUS POLYMER MATRIX WITH INORGANIC PARTICLES THEREON

[75] Inventors: Jørgen Hartfelt, Hørsholm, Denmark; Ralf Hoehn, 36 Berkeley Dr., Chelmsford, Mass. 01824

[73] Assignee: Ralf Hoehn, Chelmsford, Mass.

[21] Appl. No.: 764,777

[22] Filed: Feb. 2, 1977

[51] Int. Cl.[2] ..... B24B 1/00; C08S 51/12

[52] U.S. Cl. ..... 51/295; 51/296; 51/298 R

[58] Field of Search ..... 51/295, 296, 298

[56] References Cited

U.S. PATENT DOCUMENTS

| | | | |
|---|---|---|---|
| 2,554,070 | 5/1951 | Stead | 51/293 |
| 2,876,085 | 3/1959 | Horie | 51/296 |
| 2,980,524 | 4/1961 | Morton | 51/293 |
| 3,128,580 | 4/1964 | Davis | 51/284 |
| 3,256,075 | 6/1966 | Kirk et al. | 51/296 |
| 3,262,233 | 7/1966 | Schrier | 51/293 |
| 3,607,159 | 9/1971 | Haywood | 51/298 |
| 3,653,859 | 4/1972 | Zimmer | 51/298 |
| 3,710,517 | 1/1973 | Valerio | 51/293 |
| 3,713,796 | 1/1973 | Valerio | 51/298 |
| 3,773,480 | 11/1973 | Hall et al. | 51/296 |
| 3,804,607 | 4/1974 | Jungell | 51/295 |
| 3,906,684 | 9/1975 | Marshall | 51/295 |
| 3,918,220 | 11/1975 | Jury | 51/295 |
| 3,928,949 | 12/1975 | Wagner | 51/296 |

FOREIGN PATENT DOCUMENTS

| | | | |
|---|---|---|---|
| 969535 | 9/1964 | United Kingdom | 51/296 |

*Primary Examiner*—Donald J. Arnold
*Attorney, Agent, or Firm*—C. Bruce Hamburg

[57] ABSTRACT

An improved article for preparing critical surfaces, in particular for polishing, comprises means including a surface carrying a polishing abrasive of an average particle size less than 10 microns carried on a polymer matrix which has at least one of the following properties, microporosity, hydrophilicity and weak bonding to the polishing abrasive.

9 Claims, 2 Drawing Figures

FIG. 1
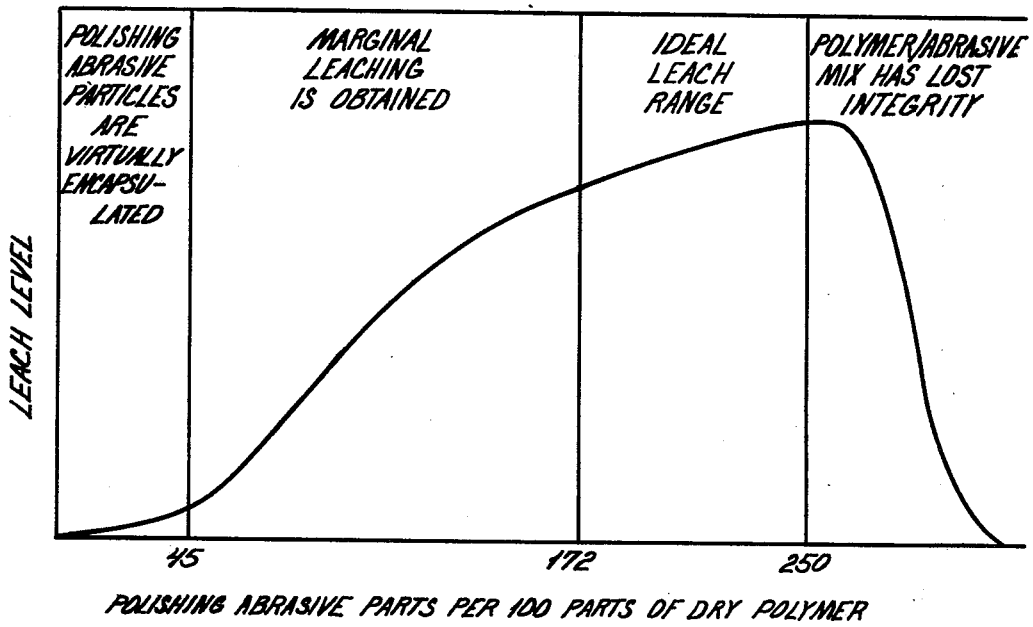
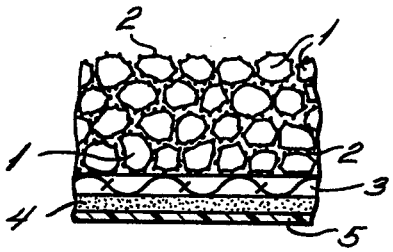
FIG. 2

ABRASIVE OF A MICROPOROUS POLYMER MATRIX WITH INORGANIC PARTICLES THEREON

BACKGROUND OF THE INVENTION

This invention relates to an improved article for preparing critical surfaces. More particularly, the invention relates to an improved article for polishing, especially for polishing lenses.

Passive tool surfacings, such as wool, felt, silk, velveteen, leather, velour, cloth, pitch, pyroxylin coated fabrics, solvent leached urethane coated fabrics (poromeric suede) and flocked fabrics have been used in combination with polishing slurries to facilitate critical surface preparation or, more specifically, to produce a polished surface on glass, plastic, metal, ceramic and semiconductor materials, metallurgical and geological specimens, quartz, semi-precious stones, piezoelectric crystals and so forth. While efforts have been made for well over twenty years to incorporate polishing abrasives into a matrix to create an active "fixed abrasive" polishing tool, pad or surface, all past efforts have resulted in essentially complete encapsulation of the polishing abrasive whereby the identity and activity of the polishing abrasive have been lost, the polishing abrasive becoming, in effect, a passive filler.

In U.S. Pat. No. 2,865,725 there is disclosed a lens polishing article comprising a cotton fabric coated on at least one side with an abrasive substance comprising cellulose nitrate, a solvent and cerium oxide. Unfortunately, in actual practice the cerium oxide becomes encapsulated in the cellulose nitrate rendering the cerium oxide essentially useless as an abrasive.

U.S. Pat. No. 3,959,935 discloses a pad for grinding lens blanks in which the grinding abrasive is fixed to a surface of the pad. In grinding, however, the particles of abrasive used are substantially coarser than the particle size of abrasive used for polishing. Of course, encapsulation of larger particles is much easier to avoid than encapsulation of smaller particles. Also, grinding is based on mechanical stock removal only, permitting the use of firmly bonded abrasive grains or particles.

U.S. Pat. No. 3,230,672 discloses a "fining," i.e., fine grinding sheet comprising a mesh fabric having interstices, a layer of stabilized latex bonding material on one side of the fabric and partly in the interstices of the fabric and grit particles embedded in the bonding material and yieldingly supported thereby, the particles being preponderantly characterized by having flat plan facets thereon and by being oriented to present the flat plane facets substantially in a common plane parallel to the fabric, corners and edges of the particles being disposed laterally of the fabric and downward toward and into the interstices. The latex is not hydrophilic, and it is required that the grit particles be of a certain configuration and a certain orientation relative to the fabric.

U.S. Pat. No. 3,491,495 discloses a cleaning towel comprising a highly absorbent web coated with a dry cleaning composition including a binder, a relatively porous and absorbent low bulk density cleaning powder and a relatively non-porous and non-absorbent high bulk density carrier powder. The carrier powder is present in an amount sufficient to inhibit the tendency of the cleaning powder to dry out a coating slurry of the cleaning powder and carrier powder in a liquid vehicle. At least 40% by weight of the particles are in the 10 to 40 micron size range. Such a product is unsuitable for preparing, i.e., polishing, critical surfaces.

It is an object of the invention to provide an improved abrasive article for preparing critical surfaces on the surface of which article is carried a polishing abrasive. The polishing abrasive adheres to or is partially embedded in but free rolling on the surface of the article and thereby is effective for polishing. It is a more particular object of the invention to provide such an improved article for polishing critical surfaces, especially for polishing lenses. It is a further object of the invention to provide an improved abrasive article for producing a polished surface on glass, plastic, metal, ceramic and semi-conductor materials, metallurgical and geological specimens, quartz, semi-precious stones, piezoelectric crystals and so forth.

Other objects and advantages of the invention will be apparent from the following description.

SUMMARY OF THE INVENTION

According to the invention, there is provided an improved abrasive article for polishing surfaces comprising means including a polymeric matrix having adhered thereto a polishing abrasive of an average particle size less than 10 microns, the polymeric matrix having at least one of the following properties, microporosity, hydrophilicity and weak bonding to the polishing abrasive.

BRIEF DESCRIPTION OF THE DRAWINGS

FIG. 1 is a rough plot of the extent to which abrasive is leached from an abrasive article according to the invention, as determined non-numerically by observing the effectiveness of the product for polishing; and FIG. 2 is a partly schematic cross section of an abrasive article according to the invention.

DETAILED DESCRIPTION OF PREFERRED EMBODIMENTS

The polishing abrasives used in the present invention are of average particle size less than 10 microns. They belong primarily to the "rare earth oxide" or "metallic oxide" family of polishing compounds and include, but are not necessarily limited to, cerium oxide, zirconium oxide, alumina, ferric oxide (rough), tin oxide, colloidal silica, chromium oxide, jewelers rouge, pumice, quartz flour and so forth.

In one type of embodiment of the invention, the microporous polymer serves as a sponge-like matrix for the polishing abrasive. More particularly, the microporous polymeric structure is one in which the polymer is in the form of platelets. The polishing abrasive particles are attached to the surface of the platelets. The platelets form the microporous, sponge-like structure. The principle of the invention is applicable to the use of any polymer which forms platelets. The polymer itself is preferably but not necessarily hydrophilic. The surface to be polished is rubbed against the abrasive surface of a polishing article according to the invention in the presence of a liquid. The liquid may be any liquid conventionally used together with abrasives for polishing. Water and aqueous liquids are preferred. It has been theorized that glass polishing, particularly in the presence of water, involves chemical activity as well as mechanical activity. Other particularly suitable liquids for use in the present invention are those containing a sufficient proportion of hydroxyl groups, such as lower aliphatic alcohols, to behave like water toward a hydrophilic material, viz. to be particularly readily adsorbed thereby. Other liquids conventionally used in polishing, such as kerosene, may not fully activate the unique polishing materials of the present invention though the use thereof is not necessarily excluded from the scope of the application of the present invention. The combined action of the rubbing and the absorption of the liquid into the sponge-like polymer matrix effects controlled release of the polishing abrasive from the polymer matrix during the polishing operation, which is a unique feature of the present invention. When the polymer is hydrophilic and the liquid is water-containing, not only do the micropores absorb water but, also, the polymer itself adsorbs water. Heretofore, actual commercial practice in polishing, particularly of lenses, has involved the use of a slurry of abrasive particles, which is eliminated by the present invention.

One readily available type of platelet forming polymers are hydrophilic urethane polymers. Examples of hydrophilic water-absorbing urethane polymers are the products sold under the trademarks "Hypol" of W. R. Grace & Co. such as the "Hypol FHP" line of products (such as the products described in U.S. Pat. No. 3,889,417 of W. R. Grace & Co.) and a custom product "Hypol P-740" available from Polymerics Inc. or W. R. Grace & Co., "Latex X-1128" of BASF Wyandotte Corporation, "Desmolac XP-D-402" of Mobay Chemical Co. and the like. The products of U.S. Pat. No. 3,889,417, such as "Hypol FHP" polymers, are isocyanate capped polyoxyethylene polyols which readily react with water. "Hypol P-740" is a latex suspension of a blocked isocyanate capped polyoxyethylene polyol. The blocking prevents reaction with water at temperatures below 250° F., permitting the blocked isocyanate capped polyoxyethylene polyol to be formulated as a latex. The principle of the invention is applicable to the use as the matrix of any polymer which upon drying, and, in some cases, curing coincident thereto, forms a microporous structure of platelets rather than a monolithic film. There are numerous well known such polymers.

It has also been found, however, that if the polymer matrix is constituted of a hydrophilic water adsorbing polymer or a polymer which forms only a week bond with the polishing abrasive particles, sufficient gradual or controlled release, viz., leaching or rubbing induced release, of the polishing abrasive from the matrix for the purposes of this invention will be attained, even if the polymer does not form platelets. Examples of such polymers are hydrophilic water-adsorbing acrylic polymers, such as the family of such polymers sold under the trademark "Hydron" of National Patent Development Company, other acrylic polymers as well as acrylic ester copolymers, butadiene-styrene and other butadiene copolymers, nylon-8, alcohol suspended nylon copolymers, uncured nitrile rubber (no Zn or S present) and polymer blends such as 80%, by weight, polyvinyl alcohol with 20%, by weight, conventional hydrophobic acrylic polymer, the blend being hydrophilic and water-adsorbing but not swelling and dissolving.

The polishing articles of the invention may take many forms and may be made in many ways. The article may be in the form of a mixture of the polishing abrasive and polymer matrix forming a flexible layer on a flexible backing such as a fabric or other carrier web. The layer or coating may be level or textured or patterned, the texture or pattern being obtained by conventional means such as embossing, scoring and the like. There may be mentioned as examples of flexible backings, woven and non-woven cotton, cotton-polyester blend and rayon fabrics, paper and the like. The function of the backing is to provide physical integrity. A particularly typical backing is desized woven cotton fabric having a weight of 100 grams per square meter. To the uncoated side of the backing may be applied a conventional pressure sensitive adhesive and the entire adhesive surface may be protected with a conventional siliconized paper. Then the tape may be die cut to form individual abrasive pads. One means of die cutting involves slitting the material into long tapes and employing rotary die cutting equipment by the use of which the cuts extend through the abrasive tape but not through the protective paper so that the paper maintains the integrity of the tape. To facilitate the user's removal from the paper of the individual abrasive pads thus formed, preferably the material surrounding the pads is stripped and discarded as part of the manufacturing process. The die cutting and discarding of unwanted cut out material may include the formation of radial cut outs in the individual abrasive pads, which facilitate the conforming of the pad to a tool surface to which the pad is applied by the user.

Instead of being coated, the mixture of polishing abrasive and polymer matrix may be printed on the backing. In other words, by use of a printing screen or other conventional means, the mixture may be applied as a regular or random pattern of dots or spots rather than as a continuous coating. Instead of being coated or printed, the mixture of the polishing abrasive and the polymer matrix may be saturated into a woven or non-woven textile or paper carrier so that the carrier is impregnated with the mixture. Another alternative is to blend a reinforcing material, such as fibers, into the mixture and mold the mixture into blocks or other shapes suitable for use of the reinforced mixture as a polishing tool. Yet another alternative is to mold the reinforced mixture into slabs or sheets which are not so thick as to prevent the product from being flexible. From that point, products similar to the carrier backed coatings may be produced.

Whether the mixture is to be applied to the surface of a substrate, impregnated into a substrate or molded, it may have incorporated therein hydrophilic fillers to aid the controlled release of the polishing abrasive during the polishing operation or, for the same purpose, slurry soluble fillers to create self generating surface voids or blowing agents to create a microcellular structure.

The hydrophilic polymers generally are supplied as latices or may readily be made up into latices by following the supplier's published instructions. After the mixture of polymer latex, polishing abrasive and any of the aforementioned additives is coated, printed, impregnated or molded, the resultant wet product is placed in an oven under conditions which will evaporate the moisture and fuse the polymer particles, for example 250°–325° F. for up to 10 minutes. The exact time and temperature are determined empirically and depend upon the grade of the latex used, the wet product thickness, the nature of any substrate used and the like.

Hydrophilic urethane polymer latices as supplied by the manufacturer typically have a solids content of about 50% by weight. With such a latex and cerium oxide as a polishing abrasive, it has been found that the optimum ratio, by weight, of latex to polishing abrasive is from about 40:60 to about 50:50. The ratios are determined empiracally. The mixture must be of sufficiently thick consistency to be coatable, formable or moldable and contain a sufficient proportion of polishing abrasive relative to polymer to yield a product from which the polishing abrasive is released at an adequate rate and which polishes effectively and efficiently. Based on a latex having a solids content of 50%, by weight, the maximum ratio, by weight, of latex to polishing abrasive is about 80:20, above which encapsulation of the abrasive particles will occur and no leaching of the abrasive from the matrix can be effected. At the other extreme, provided a sufficiently dilute latex is used, the minimum ratio, by weight, of latex to polishing abrasive may be as low as about 10:90. The latex and the polishing abrasive are so selected that the pH of one is compatible with the pH of the other. The relative proportions of polymer and polishing abrasive can also be expressed, for example, as parts, by weight of polishing abrasive per 100 parts, by weight, of dry polymer. FIG. 1 is a plot of "leach level" against parts, by weight, of polishing abrasive per 100 parts, by weight, of dry polymer. "Leach level" is a non-numerical evaluation of the effectiveness of the polishing pad. This evaluation is equated to leach level because it is the leaching, i.e., the controlled release, of the polishing abrasive which greatly contributes to the effectiveness of the polishing articles of the invention. At polishing abrasive concentrations of up to about 45 parts of polishing abrasive per 100 parts of dry polymer, the polishing abrasive particles are virtually encapsulated by the polymer. The leach level is very low, i.e., insufficient polishing can be accomplished in a commercially reasonable length of time. At polishing abrasive concentrations of from about 45 parts of polishing abrasive to about 172 parts of polishing abrasive per 100 parts of dry polymer, marginal leaching is obtained, i.e., sufficient polishing can be accomplished only in a length of time longer than desired for commercial purposes. The ideal leach range, at which sufficient polishing is attained in a commercially reasonable length of time, is polishing abrasive concentrations of from about 172 to about 250 or somewhat higher parts of polishing abrasive per 100 parts of dry polymer. At higher concentrations of the polishing abrasive, the mixture of polymer and abrasive loses its integrity. In other words, the abrasive does not leach from the polymer matrix when the surface to be polished is rubbed with the polishing pad but the mixture of polymer and abrasive falls apart on a gross scale, whereby the abrasive is too quickly exhausted.

In a typical example according to the invention, a 50:50 mixture, by weight, of cerium oxide having an average particle size of 2–4 microns and a blocked isocyanate capped polyoxyethylene polyol urethane polymer latex of 51%, by weight, solids content ("Hypol P-740") was coated onto 100 grams per square meter desized woven cotton fabric at the rate of 400 grams per square meter. The coated fabric was dried in an oven at 250°–325° F. for about 5 to 1½ minutes whereby a dry coating weight of about 300 grams per square meter was obtained. Conventional pressure sensitive adhesive was coated onto the other face of the fabric and the adhesive coating was covered with a conventional siliconized paper. The coated fabric was die cut and the excess coated fabric was discarded to form a plurality of discrete abrasive pads adhered to the siliconized paper. The pads are readily peeled from the siliconized paper, applied to a polishing tool and, with the application of water or other liquid as a lubricant and coolant used to polish lenses. In another typical example according to the invention, the same coating, after drying, was heated in the oven at about 300°–325° F. for about 5 minutes. This resulted in unblocking and curing of the urethane polymer, the resulting polishing pad appearing to be somewhat more abrasion resistant and longer wearing than the other. In another example, "Hydron" was substituted for "Hypol P-740" with satisfactory results. In yet another example, non-curing nitrile rubber was substituted for "Hypol P-740" with satisfactory results.

As seen in FIG. 2, in which an abrasive pad according to the invention is partially schematically illustrated in cross section, the abrasive coating is constituted of a polymer matrix in the form of platelets 1 and on the platelets 1 are adhered or slightly embedded particles 2 of the polishing abrasive. This abrasive particle carrying matrix adheres to a face of a backing fabric 3. To the other face of the backing fabric 3 is adhered a coating of pressure sensitive adhesive 4 overlying which is a siliconized release paper 5. This abrasive pad is used in the manner described hereinabove.

While the invention has been particularly described with reference to certain specific embodiments thereof, it is to be understood that such embodiments are intended to illustrate rather than to limit the invention and that variations and modifications obvious to one of ordinary skill in the art are intended to be encompassed by the hereto appended claims.

What is claimed is:

1. An improved article for preparing critical surfaces, consisting essentially of platelets of a polymer and an inorganic polishing abrasive of an average particle size less than 10 microns, the platelets forming a microporous sponge-like polymer matrix which is liquid absorbing, essentially all of the abrasive particles being entirely unencapsulated and being carried on the surfaces of the platelets.

2. An article according to claim 1, in which the polymer is a hydrophilic aqueous liquid adsorbing polymer.

3. An article according to claim 1, in which the polishing abrasive is selected from the group consisting of rare earth oxides and metallic oxides.

4. An article according to claim 3, in which the polishing abrasive is selected from the group consisting of cerium oxide, zirconium oxide, alumina, ferric oxide, tin oxide, colloidal silica, chromium oxide, jewelers rouge, pumice and quartz flour.

5. An improved article for preparing critical surfaces, consisting essentially of a polymer which bonds weakly to polishing abrasives and a polishing abrasive of an average particle size less that 10 microns, the bonding being sufficiently weak that the rubbing of the surface in a polishing operation will effect controlled release of polishing abrasive from the polymer, essentially all of the abrasive particles being entirely unencapsulated and being only weakly bonded onto the polymer.

6. An improved article for preparing critical surfaces, consisting essentially of a substrate and abrasive means supported on the substrate, the abrasive means consisting essentially of platelets of a polymer and an inorganic polishing abrassive of an average particle size less than 10 microns, the platelets forming a microporous sponge-like polymer matrix which is liquid absorbing, essentially of the abrasive particles being entirely unencapsulated and being carried on the surfaces of the platelets.

7. An article according to claim 6, in which said substrate is flexible.

8. An article according to claim 7, in which said substrate comprises a textile or paper.

9. An article according to claim 8, comprising a self-supporting body formed of said mixture.

* * * * *

UNITED STATES PATENT AND TRADEMARK OFFICE

CERTIFICATE OF CORRECTION

PATENT NO. : 4,138,228

DATED : February 6, 1979

INVENTOR(S) : Jørgen Hartfelt et al.

It is certified that error appears in the above-identified patent and that said Letters Patent are hereby corrected as shown below:

Column 2, line 45, change "(rough)," to --(rouge)--.
Column 4, line 68, change "empiracally" to --empirically--.
Column 6, line 47, change "that" to --than--.
lines 60-61, change "essentially of" to --essentially all of--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*